United States Patent [19]

Dickson

[11] Patent Number: 4,788,799

[45] **Date of Patent: * Dec. 6, 1988**

[54] SURFACE BLASTING APPARATUS

[75] Inventor: Wayne E. Dickson, Tecumseh, Okla.

[73] Assignee: Dickson Industries, Inc., Tecumseh, Okla.

[ * ] Notice: The portion of the term of this patent subsequent to Mar. 3, 2004 has been disclaimed.

[21] Appl. No.: 945,877

[22] Filed: Dec. 23, 1986

Related U.S. Application Data

[63] Continuation-in-part of Ser. No. 729,466, May 1, 1985, Pat. No. 4,646,481, and a continuation-in-part of Ser. No. 498,846, May 27, 1983, abandoned.

[51] Int. Cl.[4] ..... B24C 9/00

[52] U.S. Cl. ..... 51/424; 51/425; 51/432; 51/436

[58] Field of Search ..... 51/424–426, 51/428–429, 431–433, 434, 436–437, 430; 198/669

[56] References Cited

U.S. PATENT DOCUMENTS

| | | | |
|---|---|---|---|
| 2,423,287 | 7/1947 | Beisel | 51/430 |
| 3,934,373 | 1/1976 | Leliaert et al. | 51/425 |
| 4,020,596 | 5/1977 | Bergh | 51/425 |
| 4,363,571 | 12/1982 | Jackson et al. | 198/669 X |
| 4,376,358 | 3/1983 | Shelton | 51/424 X |

FOREIGN PATENT DOCUMENTS

| | | | |
|---|---|---|---|
| 2072549 | 10/1981 | United Kingdom | 51/426 |

*Primary Examiner*—Debra Meislin

*Attorney, Agent, or Firm*—Laney, Dougherty, Hessin & Beavers

[57] ABSTRACT

A surface blasting apparatus for treating a surface with abrasive, cleaning dust and debris from abrasive rebounded from the treated surface so that the abrasive may be reused, and separating the debris from the air. Air and debris flow through abrasive rebounded from said surface and through a baffle system which prevents abrasive flow therethrough. A row of magnets is positioned adjacent the baffle system for receiving and arresting abrasive exiting an abrasive return chute. A mechanical conveying system lifts abrasive upwardly so that it falls toward an abrasive storage hopper. The abrasive falls in the form of a curtain through which air exiting the baffle system passes. The air and dust contained therein enter a prefilter in a first cleaning chamber and heavy dust falls downwardly therefrom. The air flows from the prefilter into a second cleaning chamber where it is filtered so that light dust is removed therefrom and falls downwardly. Large debris is also removed from the abrasive and discharged to the first cleaning chamber. A dust and debris auger system transfers the removed dust and debris to a common opening in the first and second cleaning chambers for removal from the apparatus.

13 Claims, 3 Drawing Sheets

SURFACE BLASTING APPARATUS

This application is a continuation-in-part of U.S. patent application Ser. No. 498,846, filed May 27, 1983, now abandoned, the details of which are incorporated by reference, and this application is also a continuation-in-part of U.S. patent application Ser. No. 729,466, filed May 1, 1985 now U.S. Pat. No. 4,646,481 issued on Mar. 3, 1987.

BACKGROUND OF THE INVENTION

1. Field of the Invention

This invention relates to surface cleaning equipment, and more particularly to a surface blasting apparatus which recovers blasting abrasive and debris from the treated surface, and provides means for separating the debris from the abrasive.

2. Brief Description of the Prior Art

A number of types of surface blasters have been heretofore devised which recover abrasive and debris from the treated surface and utilize various methods to separate debris from the abrasive, so that the cleaned abrasive can be reused. Some of such surface blasting apparatus utilize mechanical pickup of the abrasive from the treated surface and a conveying system to carry the abrasive back to an abrasive storage hopper.

The prior surface blasters use a variety of methods to clean the abrasive so that the abrasive can be reused without frequent interruptions in service. One method of such cleaning is to use an air wash which passes through the abrasive carrying dust and debris away. A problem is that this air wash does not provide adequate cleaning of the abrasive, so that frequent stops to manually clean the abrasive are required. Also, the prior blasters do not adequately clean the air which is discharged from the machine which results in undesirable dust problems for the operator and passersby.

The apparatus of the present invention provides a means of adequately air cleaning the abrasive and filtering the dust and debris from the air stream.

BRIEF DESCRIPTION OF THE PRESENT INVENTION

The surface blasting apparatus of the present invention comprises magnetic receiving means for receiving abrasive rebounded from the treated surface which removes all kinetic energy therefrom, a baffle system or means for allowing air flow therethrough without passage of abrasive therethrough for a first abrasive cleaning operation, and means to draw air through the apparatus so that is passes through a falling curtain of abrasive for a second abrasive cleaning operation.

The apparatus also comprises means for removing heavy foreign debris picked up from the treated surface, heavy dust removing means in the form of a prefilter and light dust removing means in the form of a filter. The surface blaster also comprises an auger system which provides means for transferring the debris and dust to a common opening for removal from the apparatus.

One object of the present invention is to provide a baffle means for allowing air flow therethrough while preventing abrasive flow therethrough so that the air may remove dust and debris from a stream of abrasive rebounded from the treated surface.

A further object of the invention is to provide an auger means for removing large debris from the abrasive and transferring said large debris to a cleaning compartment for removal therefrom.

Still another object of the invention is to provide a means of air cleaning a flow of abrasive at two positions in the apparatus and filtering dust and debris from said air flow.

An additional object of the invention is to provide means for transferring all dust and debris removed from the abrasive and air streams to a single location in the apparatus for removal therefrom.

Additional objects and advantages of the invention will become apparent as the following detailed description of the preferred embodiment is read in conjunction with the accompanying drawings which illustrate such preferred embodiment.

DETAILED DESCRIPTION OF THE PREFERRED EMBODIMENTS

Figure 1:
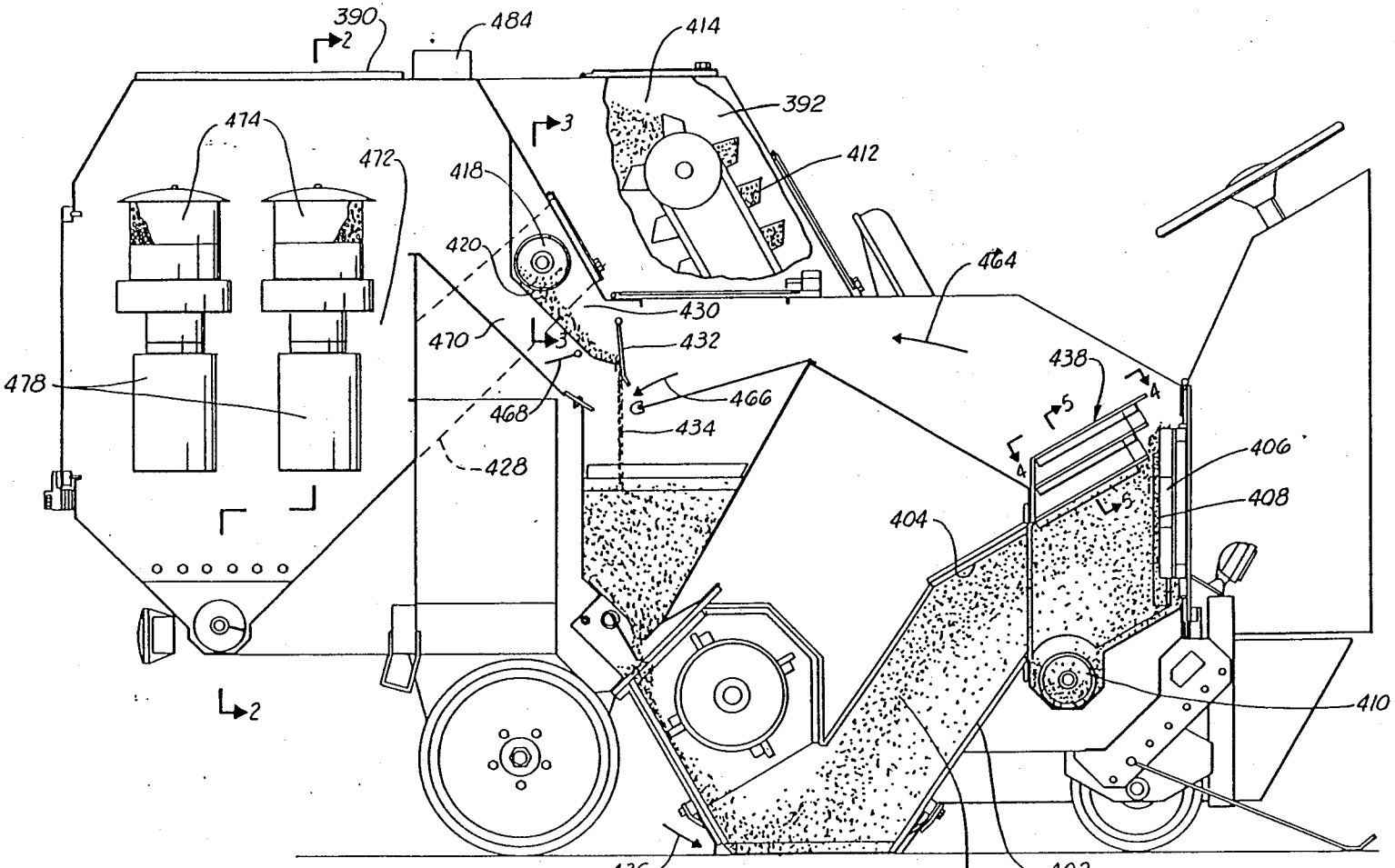
FIG. 1 is a partial longitudinal cross-section of the surface blasting apparatus of the present invention.

Referring now to the drawings, and particularly to FIG. 1, the surface blasting apparatus includes a housing 390 having a pair of opposed, substantially parallel, vertically extending side walls 392 and 394. Abrasive stored in a storage hopper is supplied to a rotary abrasive propeling blast wheel and thrown to the surface to be treated. A stream of abrasive 400 rebounds from the treated surface through abrasive return chute 402 of substantially uniform cross-section. The chute 402 forms a part of a means for recycling the abrasive particles through a circuitous return path. A deflector plate 404 at the exit of chute 402 directs abrasive 400 toward a magnetic abrasive receiving and arresting means in the form of vertically disposed magnets 406. Because the abrasive is a ferrous material, an envelope 408 of abrasive forms around magnets 406. As the stream of abrasive 400 strikes abrasive envelope 408, the abrasive is arrested and then falls downwardly, eventually coming to rest adjacent lower abrasive auger 410. The abrasive is moved transversely in the circuitous return path with respect to the surface blaster toward the lower end (not shown) of a bucket-type conveyor 412 of a kind known in the art. The abrasive is carried upwardly in the circuitous return path by conveyor 412 to a position above the storage hopper and discharged from there into upper abrasive compartment 414.

Figure 3:
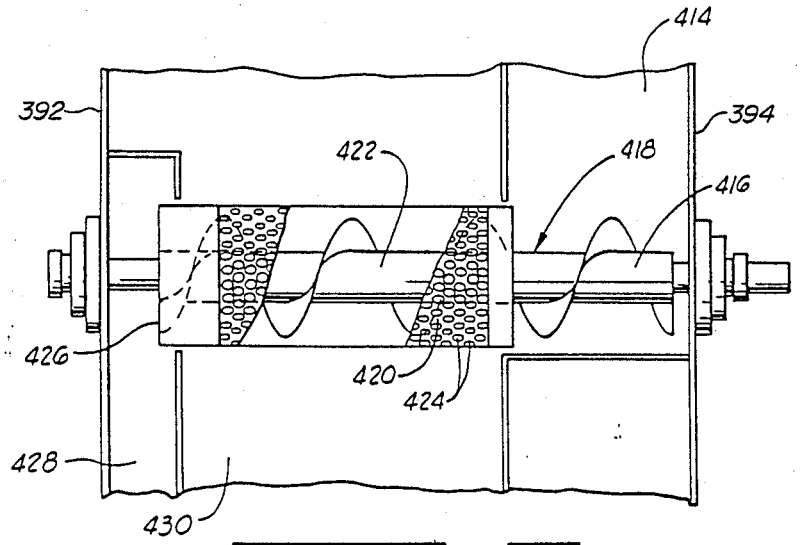
FIG. 3 is a cross-section taken along lines 3—3 in FIG. 1.

Referring now to FIGS. 1 and 3, abrasive falls downwardly in compartment 414 toward an open end 416 of an upper abrasive auger 418. The abrasive is then moved transversly in the circuitous return path by auger 418 toward filter screen 420 which encloses a second portion 422 of auger 418. As viewed in FIG. 3, the abrasive moves in a leftward direction. Filter screen 420 includes a plurality of openings 424 which are sized such that abrasive may fall therethrough. However, large debris, such as foreign material picked up from the treated surface, will not fall through openings 424 but is instead moved further transversely to fall from open end 426 of filter screen 420 into large debris chute 428.

As abrasive falls through openings 424 in filter screen 420, the abrasive enters abrasive return chute 430 and continues downwardly toward abrasive control valve 432. Abrasive control valve 432 is weighted, and when sufficient abrasive builds up in abrasive return chute 430, the valve will automatically open and abrasive will be allowed to fall downwardly toward the storage hopper, forming a curtain 434 of abrasive. The screen 420 and control valve 432 thus cooperatively form an abrasive particle curtain developing means.

Figure 4:
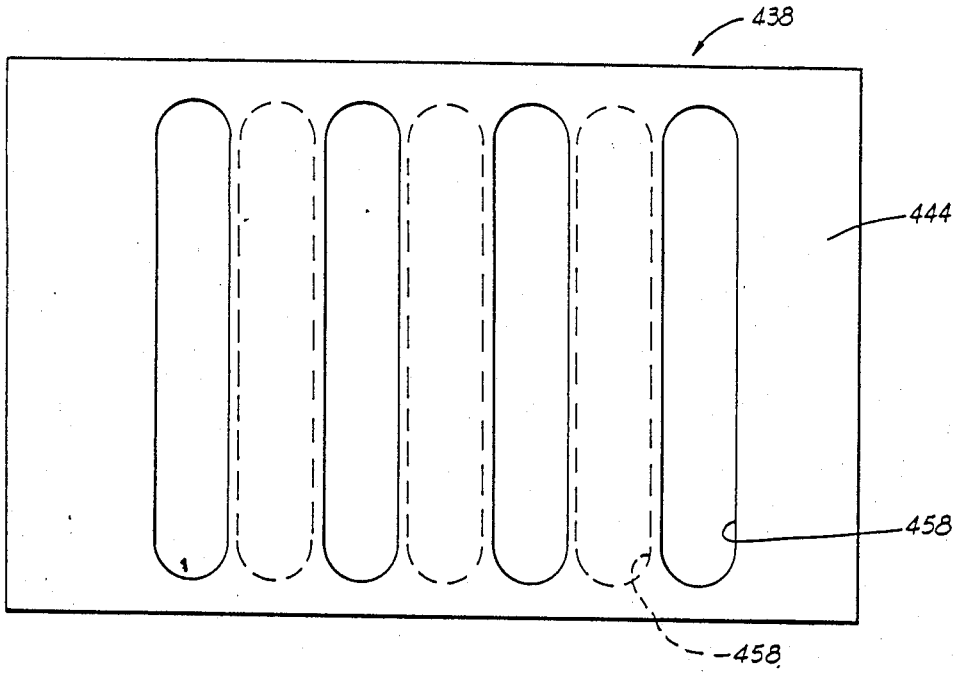
FIG. 4 is a view taken along lines 4—4 in FIG. 1.
Figure 5:
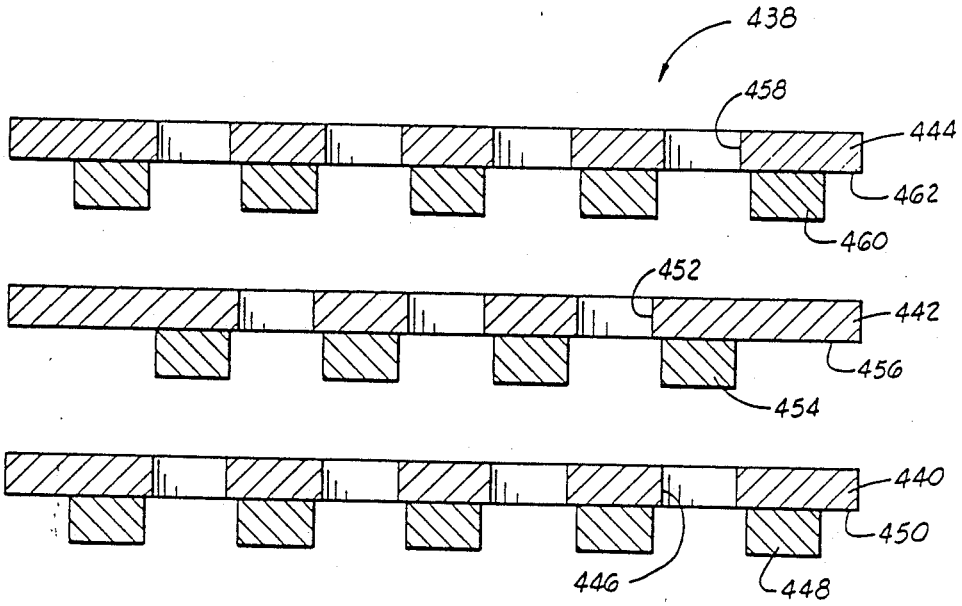
FIG. 5 is a cross-sectional view taken along lines 5—5 in FIG. 1.

Referring still to FIG. 1, air is drawn into the lower end of return chute 402 adjacent the treated surface, as indicated by arrow 436, by a fan hereinafter described. The fan and the return chute 402 form a part of a means for moving a stream of air along at least a portion of said circuitous return path. The air flows upwardly through chute 402 with abrasive 400 and then a substantial part of the air is diverted and passes upwardly through a baffle assembly 438. A part of the air moving upwardly in the return chute 402 impinges against the magnetic abrasive particle arresting means and moves past abrasive particles arrested on the magnets 406 to subject a part of the arrested abrasive particles to a scrubbing action by the air moving therepast. Referring now to FIGS. 4 and 5, baffle assembly 438 is shown in detail. In the preferred embodiment, baffle assembly 438 includes a lower baffle 440, a central baffle 442 and an upper baffle 444, but it will be clear to those skilled in the art that the number of baffles may be varied.

Lower baffle 440 defines a plurality of longitudinal slots 446 therethrough and, in an alternate embodiment, also has a plurality of longitudinally disposed magnets attached to a lower surface 450 thereof substantially parallel to slots 446. Central baffle 442 also has a plurality of slots 452 therethrough and, alternately, a plurality of parallel magnets 454 attached to lower surface 456 thereof. Similarly, upper baffle 442 has a plurality of slots 458 therethrough and, in the alternate embodiment, corresponding magnets 460 attached to lower surface 462 thereof parallel to the slots. Slots 446 in lower baffle 440 and slots 458 in upper baffle 444 are in substantial alignment, and slots 452 in central baffle 442 are staggered with respect to slots 446 and 458. Thus, any abrasive that might have a tendency to be carried upwardly with the flow of air which passes through baffle assembly 438 will be prevented from significant movement. Upwardly moving abrasive passing through slots 446 in lower baffle 440 should impinge against lower surface 456 of central baffle 442 rather than passing through slots 452. However, any abrasive that does pass through slots 452 in central baffle 442 should impinge, and be stopped by, lower surface 462 of upper baffle 444. In the alternate embodiment of baffle assembly 438, upwardly carried abrasive moving toward slots 446 will most likely be attracted, and stopped, by magnets 448, but any abrasive that does pass upwardly through slots 446 will almost certainly impinge against magnets 454 and be retained thereby, or at least stopped so that it can fall downwardly toward lower auger 410. Similarly, any abrasive that by chance passes through slots 452 should impinge magnets 460. Thus, in either embodiment, baffle assembly 438 provides a passage for air flow that should prevent any appreciable upward movement of abrasive therethrough. However, the air moving upwardly through baffle assembly 438 will carry dust and nonferrous light debris from the treated surface, thus, providing a first cleaning of the abrasive and constituting a first cleaning means.

Referring again to FIG. 1, air, and the dust and debris contained therein, which exits baffle assembly 438 moves rearwardly with respect to the surface blasting apparatus through a passageway means as indicated by arrow 464 and is directed through the falling abrasive curtain 434 as indicated by arrow 466. This further removes debris from the abrasive, providing a second cleaning thereof occurring at a second, downstream point in the circuitous return path. The flow of air and debris is controlled by air valve 468, and the air and debris moves upwardly and rearwardly through air duct 470 to enter first cleaning chamber 472.

Figure 2:
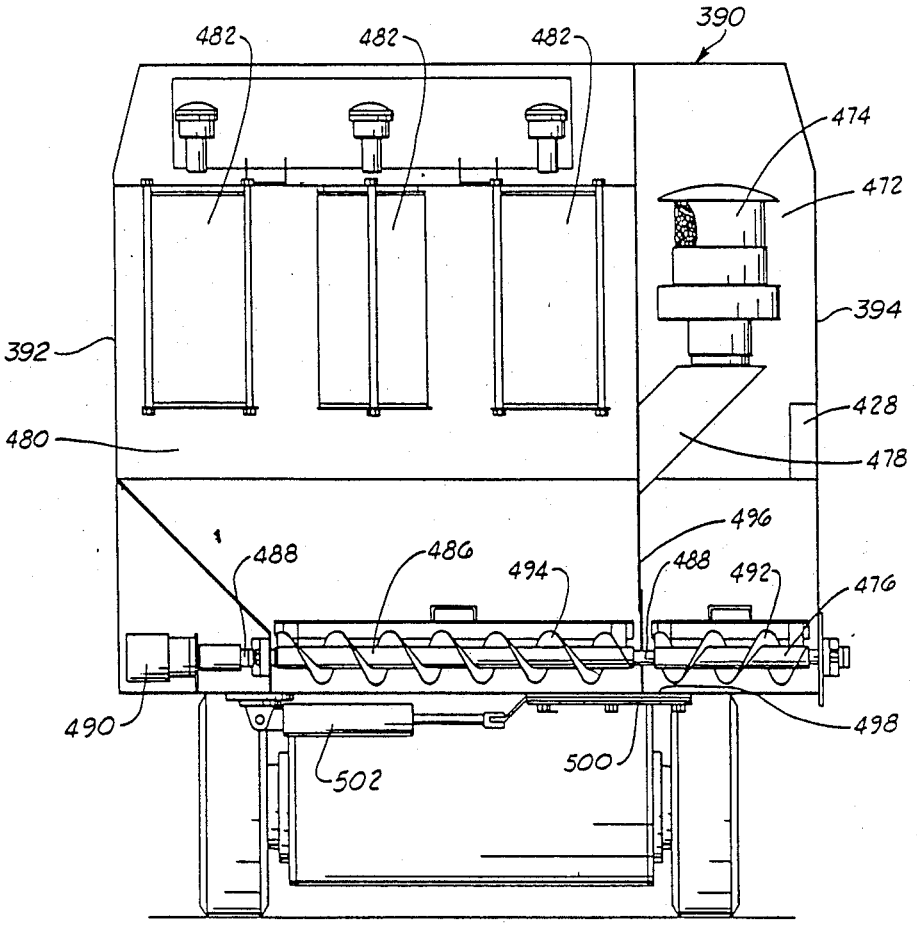
FIG. 2 is a partial cross-section taken along lines 2—2 in FIG. 1.

Referring now to FIGS. 1 and 2, the air and debris in first cleaning chamber 472 enters at least one prefilter 474. In the preferred embodiment, prefilter 474 is a cyclonic separater of the type disclosed in co-pending U.S. patent application Ser. No. 498,846. Heavy dust and debris is discharged from prefilter 474 so that it falls downwardly toward large debris auger 476 positioned at the lowermost end of first cleaning chamber 472. Large debris chute 428 also exits into first cleaning chamber 472 so that the large debris entering the chute from filter screen 420 falls downwardly towards auger 476 along with the heavy dust from prefilter 474.

The air and some light dust still contained therein exists first cleaning chamber 472 through discharge conduit 478 and enters second air cleaning chamber 480. The air and dust then flow through at least one filter 482 which removes essentially the remainder of the dust. Clean air exits the apparatus through discharge opening 484. Dust cleaned by filters 482 falls toward dust auger 486 located at the lowermost portion of second cleaning chamber 480. This is also similar to the filtering disclosed in co-pending application Ser. No. 498,846.

It will be seen that large debris auger 476 and dust auger 486 are mounted on a common shaft 488 which is driven by motor 490. The pitch of blades 492 on auger 476 and blades 494 on auger 486 are in opposite directions. Thus, as motor 490 turns shaft 488, augers 476 and 486 act as an auger means by which the debris and dust are moved transversely in both first and second cleaning chambers 472 and 480 toward divider wall 496 between the chambers. The lowermost portions of first cleaning chamber 472 and second cleaning chamber 480 adjacent wall 496 define a common opening 498 covered by a movable door 500 actuated by hydraulic cylinder 502. Door 500 can be opened when desired to remove dust and debris from the first and second cleaning chambers through opening 498.

Air is continuously drawn through abrasive chute 402, baffle assembly 438, air duct 470, first cleaning chamber 472 and second cleaning chamber 480 by a rotary fan (not shown) of a kind known in the art such as described in co-pending application Ser. No. 498,846.

It can be seen, therefore, that the surface blasting apparatus of the present invention is well adapted to carry out the objects and attain the ends and advantages mentioned, as well as those inherent therein. While a presently preferred embodiment of the invention has been described for the purposes of this disclosure, numerous changes in the construction and arrangement of parts can be made by those skilled in the art. All such changes are encompassed within the scope and spirit of this invention as defined by the appended claims.

What is claimed is:

1. A surface blasting apparatus comprising:

a housing including a pair of opposed vertically extending, substantially parallel side walls;

an abrasive blast wheel mounted within said housing for throwing abrasive against a surface to be treated;

an abrasive storage hopper above said blast wheel for providing a supply of abrasive to said abrasive blast wheel;

an abrasive return chute for receiving wheel-thrown abrasive rebounded from said surface to be treated and for conducting a flow of air therethrough;

magnetic receiving means positioned adjacent an exit of said abrasive return chute for receiving and arresting rebounding abrasive exiting said abrasive return chute;

baffle assembly means positioned adjacent said magnetic receiving means and above said abrasive exiting said abrasive return chute, said baffle assembly means allowing flow of air and dust upwardly therethrough while preventing upward movement of a major portion of the abrasive therethrough;

an upper abrasive compartment above said abrasive storage hopper and disposed between said parallel vertically extending side walls;

an abrasive conveyor means for carrying abrasive from said baffle assembly means to said upper abrasive compartment, said conveyor means including:

a horizontally extending portion, extending, in part, beneath said baffle assembly means; and a vertically extending portion receiving abrasive from said horizontally extending portion and discharging abrasive into said upper abrasive compartment;

a screen for removing large debris from said abrasive and allowing the abrasive to gravitate through the screen, said screen being supported within said housing between said side wall, and disposed below said upper abrasive compartment for receiving abrasive therefrom;

an abrasive control valve pivotally mounted in said surface blasting apparatus for rotation about a horizontal axis extending between said vertically extending parallel side walls at a location below said screen and above said abrasive storage hopper and allowing gravitating abrasive originating from said upper abrasive compartment and passing downwardly through said screen after the removal of large debris therefrom to fall downwardly to said abrasive storage hopper after a sufficient amount of abrasive has built up on said valve to cause said valve to open and allow said abrasive to gravitate into said abrasive storage hopper and allowing the abrasive to gravitate downwardly across the flow of air exiting from said baffle assembly means such that air exiting from said baffle assembly means passes through said gravitating abrasive for further removal of dust and debris therefrom;

a large debris chute having a discharge end and having a receiving end positioned adjacent and beneath one end of said screen for receiving the large debris removed from said abrasive by said screen;

a first cleaning chamber having the discharge end of said large debris chute opening thereinto, and positioned for receiving said air passed through said falling abrasive from said control valve after said air has passed through said falling abrasive to further remove dust and debris from said falling abrasive, said first cleaning chamber having a lower portion;

a pre-filter positioned in said first cleaning chamber for filtering at least a portion of said dust and debris from said air which has passed through abrasive falling from said upper abrasive compartment toward said abrasive storage hopper via said control valve, such that a filtered portion of said dust and debris falls toward a lower portion of said first cleaning chamber;

a discharge conduit positioned adjacent said pre-filter for receiving dust and debris from said pre-filter;

a second cleaning chamber adjacent said discharge conduit for receiving dust and debris passing through said discharge conduit after removal from said air by said pre-filter, said second cleaning chamber having a lower portion, and said first and second cleaning chambers being adjacent each other and defining a common opening at the lower portions thereof;

a filter positioned in said second cleaning chamber for further filtering dust and debris from said air such that said dust and debris removed by the filter in said second cleaning chamber fall downwardly toward said lower portion of said second cleaning chamber;

a large debris auger positioned in said first cleaning chamber for transferring said large debris and dust toward said common opening; and a dust auger positioned in said second cleaning chamber for transfering said dust toward said common opening.

2. The apparatus of claim 1 wherein said large debris auger and said dust auger are mounted on a single shaft extending through said lower portions of said first and second cleaning chambers.

3. A surface blasting apparatus of the type using abrasive particles to clean a surface comprising:

an abrasive blast wheel for throwing abrasive particles against a surface to be treated;

an abrasive storage hopper for providing a supply of abrasive particles to said abrasive blast wheel;

abrasive particles stored in said storage hopper;

an abrasive return chute for returning abrasive particles rebounded from said surface, and for passing a stream of abrasive particles upwardly and laterally in said chute, said chute being inclined at an acute angle to the vertical and enclosing and defining an upwardly and laterally extending abrasive particle flow path which corresponds generally to the angle of rebound of abrasive particles from said surface;

means for inducing entry of air into said stream of abrasive particles moving upwardly in said return chute for removal of dust and debris therefrom; and baffle means positioned adjacent and above the exit of said abrasive return chute within the projection of the upwardly and laterally extending abrasive flow path and defining an undulating, tortuous air-flow path from the lower side thereof to the upper side thereof, and positioned to receive air, dust and a portion of the rebounded abrasive particles from the exit at the upper end of said abrasive return chute and for allowing said air to flow upwardly through said tortuous, undulating path defined by said baffle means, while preventing the movement of a major portion of the abrasive particles upwardly through said baffle means in opposition to the force of gravity exerted downwardly thereon, thereby enabling the air moving through said baffle means to scrub the abrasive particles to remove dust and debris therefrom, said baffle means being positioned directly above the exit of said abrasive return chute so that a substantial portion of the abrasive particles rebounded from said surface rebound directly and in a straight line onto said baffle means, and so that a portion of the kinetic energy of said particles is dissipated by impact with said baffle means.

4. The surface blasting apparatus as defined in claim 3 wherein said baffle means is characterized by a plurality of baffle plates, each of said baffle plates defining a plurality of slots therethrough, and said baffle plates being located one above the other through each baffle plate with the slots through each baffle plate staggered with respect to the slots in at least one of the other baffle plates, whereby said tortuous air-flow path is defined by the movement of air between the slots in said baffle plates.

5. The apparatus of claim 3 further comprising an abrasive conveyor means for carrying said abrasive to a position above said storage hopper, said abrasive conveyor means comprising:

a horizontally extending auger conveyor partially positioned beneath said baffle means for receiving abrasive rejected by said baffle means and moving the thus received abrasive transversely with respect to said surface blaster; and a vertically extending bucket-type conveyor receiving abrasive from said auger conveyor and elevating it to a position of abrasive release above said storage hopper.

6. A surface blasting apparatus as defined in claim 3 and further characterized as including:

magnetic abrasive particle receiving and arresting means positioned adjacent said baffle means at a location on one side of said baffle means in a substantially vertically extending plane which extends across and intersects the path of upward and lateral movement of a portion of said abrasive particles in said abrasive return chute after said particles have struck or passed by said baffle means, whereby a portion of the air moving upwardly in said return chute with said abrasive particles will impinge against said magnetic abrasive particle receiving and arresting means and against abrasive particles magnetically retained thereon, and whereby a portion of said abrasive particles shall impact said abrasive receiving and arresting means and be retained thereon for subjection to a scrubbing action by air moving therepast enroute to passage upwardly through said baffle means, said retained particles being removed from said arresting means by impact of air and additional magnetic particles rebounding upwardly in said abrasive return chute, said baffle means and said magnetic particle receiving and arresting means cooperating with each other and with gravity to (a) change the direction of movement of said abrasive particles from upwardly and laterally with respect to said surface to be cleaned, to downwardly in the general direction of said surface to be cleaned, and to (b) thoroughly air scrub said abrasive particles to remove dust and debris therefrom, and to entrain such dust and debris in air moving upwardly through said baffle means.

7. A surface blasting apparatus comprising:

an abrasive blast wheel for throwing abrasive against a surface to be cleaned by the scouring action of abrasive particles impinging on said surface;

an abrasive storage hopper for providing a supply of abrasive particles to said abrasive blast wheel;

an abrasive return chute for receiving abrasive particles rebounding upwardly from said surface to be cleaned by abrasive particle scouring action, and for conducting a stream of such rebounding abrasive particles upwardly and laterally in said chute at an angle to the vertical;

means for producing the entry of air into said stream of abrasive particles moving upwardly and laterally in said chute for movement with the particles;

baffle means defining an undulating, tortous air-flow path from the lower side thereof to the upper side thereof, and positioned adjacent and above an exit at the upper end of said abrasive return chute for allowing said air to flow upwardly therethrough through said tortuous, undulating path around portions of said baffle means while preventing the movement of a major portion of the abrasive particles upwardly through said baffle means in opposition to the force of gravity exerted downwardly thereon, to thereby enable the air moving through said baffle means to scrub the abrasive particles to remove dust and debris therefrom;

magnetic abrasive particle receiving and arresting means positioned adjacent said baffle means at a location at one side of said baffle means in a vertically extending plane which extends across and intersects the path of upward and lateral movement of abrasive particles in said abrasive return chute, whereby a portion of the air moving upwardly in said return chute with said abrasive particles will impinge against said magnetic abrasive particle receiving and arresting means, and against abrasive particles magnetically held thereon, and whereby a portion of said abrasive particles shall impact said magnetic abrasive receiving and arresting means and be held thereon for subjection to a scrubbing action by air moving therepast, said held particles being removed from said arresting means by impact of additional magnetic particles rebounding upwardly in said abrasive return chute, said baffle means and said magnetic particle receiving and arresting means cooperating with each other and with gravity to (a) change the direction of movement of said abrasive particles from upward and laterally with respect to said surface to be cleaned, to downwardly, and to (b) thoroughly air scrub said abrasive particles to remove dust and debris therefrom and entrain such dust and debris in air moving upwardly through said baffle means; and conveyor means having a portion below said baffle means and said magnetic particle arresting means for catching gravitating abrasive particles falling from said baffle means and said arresting means, and for conveying said abrasive particles to said abrasive storage hopper for re-use in said surface blasting apparatus.

8. In a surface blasting apparatus of the type using abrasive particles to impact a surface to be cleaned, the improvement which comprises:

a horizontally extending screen for removing large debris from the abrasive particles used in said surface blasting apparatus, and defining openings through which the abrasive particles gravitate downwardly therefrom;

means for directing air across the underside of said screen in a horizontal direction of flow substantially normal to the gravitating abrasive particles for cleaning the abrasive particles as the air passes therethrough;

a large debris chute positioned under one end of said horizontally extending screen for receiving said removed large debris from said screen;

dust removing means for removing dust from air which has been directed past and across said falling abrasive particles for cleaning the abrasive, said dust removing means including:

a pre-filter for removing coarse dust from said air used to clean the abrasive used in said surface blasting apparatus; and additional filters positioned for receiving air and relatively fine dust from said pre-filter and for separating dust from the air received in said additional filters;

a first cleaning chamber containing said pre-filter and positioned for receiving said large debris discharged from said large debris chute, and for also receiving at least a portion of said coarse dust removed by said pre-filter forming a part of said dust removing means, said first cleaning chamber having a lower portion;

a second cleaning chamber containing said additional filters and positioned alongside and adjacent said first cleaning chamber for receiving at least a portion of said relatively fine dust removed by said additional filters forming a part of the dust removing means, said second cleaning chamber having a lower portion, and said adjacent first and second cleaning chambers defining a common, horizontally extending opening at the lower portions of said first and second cleaning chambers; and auger means in the lower portions of said first and second cleaning chambers for transferring the dust and large debris received in the first and second cleaning chambers toward said common opening.

9. The apparatus of claim 8 wherein said auger means is characterized by:

a rotatable shaft extending through said lower portions of said first and second cleaning chambers and across said common opening;

a large debris auger positioned in said first cleaning chamber and attached to said shaft for rotation therewith, said auger including a helical blade thereon pitched in one direction; and a dust auger positioned in said second cleaning chamber and attached to said shaft for rotation therewith, said dust auger having a helical blade attached thereto and pitched in a direction which is opposite from the pitch of the helical blade carried on said large debris auger, whereby; as said shaft is rotated, said dust and large debris in said first cleaning chamber are moved toward said common opening, and said dust in said second cleaning chamber is moved toward said common opening in a direction opposite to that in which dust and large debris is moved by such large debris auger.

10. The apparatus of claim 8 wherein said common opening is covered by a movable door.

11. In a surface blasting apparatus for cleaning a surface by directing abrasive particles against the surface, which apparatus includes an abrasive propelling wheel for propelling abrasive particles against the surface to be cleaned, and means for recycling the abrasive particles rebounding from the surface to be cleaned through a circuitous return path to a supply hopper for resupply to the abrasive propelling wheel, and further including means for moving a stream of air along at least a portion of said abrasive particle circuitous return path in admixture with the abrasive particles moving through said circuitous return path, the improvement for cleaning the abrasive particles of dust and debris while said abrasive particles are transvering said circuitous return path and prior to their return to the supply hopper, said cleaning being effected by means of air washing the abrasive particles at at least two points along said circuitous return path with air derived from said air stream, said cleaning by the air washing improvement comprising:

cleaning means located at an upstream, first cleaning point in said circuitous return path, said cleaning means being positioned to divert and separate a substantial portion of said air stream from said abrasive particles moving in said circuitous return path after the abrasive particles have rebounded from the surface to be cleaned and are mixed with dust and debris blasted from the cleaned surface, said cleaning means causing the diverted and separated portion of the air stream to carry dust with it away from said circuitous return path and the abrasive particles moving through said circuitous path;

said air washing improvement further including an abrasive particle curtain-developing screen positioned adjacent, and immediately upstream from, a second cleaning point in said circuitous return path, said screen being interposed in said circuitous return path of the abrasive particles for separating the abrasive particles and dust from large debris blasted from the cleaned surface by passing the abrasive particles and dust through the screen and into a gravitating abrasive particle curtain falling through said diverted and separated portion of the air stream at said second cleaning point in said circuitous return path to thereby cause the abrasive particles to undergo air washing at said second point;

passageway means extending from said first point to said second point for conducting and directing said separated substantial portion of said air stream and entrained dust from said first point in said circuitous return path of said abrasive particles at which said separated, substantial portion of said air stream is separated from said abrasive particles, to said second point downstream in said circuitous return path at which said separated substantial portion of the air stream is directed through said gravitating abrasive particles curtain;

dust removing means interposed in said substantial portion of said air stream downstream from said second point for removing dust from the substantial portion of said air stream after it is passed across and through said gravitating curtain of abrasive particles in said circuitous return path at said second point, said dust removing means separating dust from said substantial portion of said air stream;

chamber means for receiving said large debris removed by said screen, and said dust removed by said dust removing means, and including an opening at the bottom of said chamber means; and auger conveyor means within the lower portion of said chamber means for receiving and then transferring dust and large debris falling downwardly in said chamber means toward said opening as said dust and large debris gravitates onto said auger conveyor means within said chamber means.

12. A surface blasting apparatus comprising:

means for propelling abrasive particles against a surface to be cleaned by the scouring action of the abrasive particles impinging on such surface;

storage hopper means for containing the abrasive particles at a location above said abrasive propelling means for gravitationally supplying abrasive particles to said abrasive particle propelling means;

an inclined chute for receiving abrasive particles rebounding upwardly from said surface to be cleaned by abrasive particle scouring action, and for conducting the stream of rebounding abrasive particles upwardly and laterally at an angle to the vertical;

means for inducing a flow of air into said chute for admixture with rebounding abrasive particles in said chute as the abrasive particles move upwardly and laterally in said chute;

baffle means defining an undulating, tortuous air-flow path from the lower side of the baffle means to the upper side thereof, and positioned adjacent and above said exit at the upper end of said abrasive return chute for allowing the air mixed with the abrasive in the chute to flow upwardly therethrough through the tortuous, undulating path around portions of said baffle means, while preventing the movement of abrasive particles upwardly through said baffle means in opposition to the force of gravity exerted downwardly thereon, to thereby enable the air moving through said baffle means to scrub the abrasive particles to remove dust and debris therefrom;

magnetic abrasive particle receiving and arresting means positioned adjacent said baffle means at a location at one side of said baffle means in a substantially vertically extending plane which extends across, and intersects, the path of upward and lateral movement of said abrasive particles in said chute after said abrasive particles have struck or passed by said baffle means, whereby a portion of the air moving upwardly in said chute with said abrasive particles will impinge against said magnetic abrasive particle receiving and arresting means, and against abrasive particles magnetically retained thereon, and whereby a portion of said abrasive particles impact said abrasive receiving and arresting means and are held thereon for subjection to a scrubbing action developed by the air moving therepast, said retained abrasive particles being removed, in substantial part, from said arresting means by impact of additional abrasive particles rebounding upwardly in said return chute, said baffle means and said magnetic particle receiving and arresting means cooperating with each other and with gravity to (a) change the directional movement of abrasive particles from upward and laterally with respect with said surface to be cleaned, to downwardly in the general direction of said surface to be cleaned, and to (b) thoroughly air scrub abrasive particles to remove dust and debris therefrom, and to entrain such removed dust and debris from the air moving upwardly through said tortuous undulating path defined by said baffle means;

conveyor means disposed below said baffle means and below said magnetic abrasive particle receiving and arresting means for carrying abrasive particles from a location below said baffle means and magnetic abrasive particle receiving and arresting means to said abrasive storage hopper means, said conveyor means including:

a horizontally extending conveyor portion having one end thereof beneath said baffle means and said magnetic abrasive particle receiving and arresting means for receiving abrasive particles therefrom;

a vertically extending conveyor portion for receiving abrasive particles from said horizontally extending portion and carrying said abrasive particles upwardly to a point of discharge;

an upper abrasive compartment spaced above said storage hopper and positioned for receiving abrasive particles from said vertically extending conveyor portion and for gravitating abrasive particles through the space between said upper abrasive compartment and said storage hopper means; and passageway means for conducting and directing air from a point of discharge from said baffle means after passage through said tortuous, undulating path, to said location where abrasive particles are gravitated from said upper abrasive compartment toward said abrasive storage hopper means whereby said gravitating abrasive particles are further cleaned by additional air scrubbing occurring at the location of such abrasive particle gravitation.

13. A surface blasting apparatus comprising:

means for propelling abrasive particles against a surface to be cleaned by the scouring action of the abrasive particles impinging on such surface;

storage hopper means for containing the abrasive particles at a location above said abrasive propelling means for gravitationally supplying abrasive particles to said abrasive particle propelling means;

an inclined chute for receiving abrasive particles rebounding upwardly from said surface to be cleaned by abrasive particle scouring action, and for conducting the stream of rebounding abrasive particles upwardly and laterally at an angle to the vertical;

means for inducing a flow of air into said chute for admixture with rebounding abrasive particles in said chute as the abrasive particles move upwardly and laterally in said chute;

baffle means defining an undulating, tortuous air-flow path from the lower side of the baffle means to the upper side thereof, and positioned adjacent and above said exit at the upper end of said abrasive return chute for allowing the air mixed with the abrasive in the chute to flow upwardly therethrough through the tortuous, undulating path around portions of said baffle means, while preventing the movement of a substantial portion of said abrasive particles upwardly through said baffle means in opposition to the force of gravity exerted downwardly thereon, to thereby enable the air moving through said baffle means to scrub the abrasive particles to remove dust and debris therefrom;

magnetic abrasive particle receiving and arresting means positioned adjacent said baffle means at a location at one side of said baffle means in an upwardly extending plane which extends across, and intersects, the path of upward and lateral movement of said abrasive particles in said chute after said abrasive particles have struck or passed by said baffle means, whereby a portion of the air moving upwardly in said chute with said abrasive particles will impinge against said magnetic abrasive particle receiving and arresting means, and against abrasive particles magnetically retained thereon, and whereby a portion of said abrasive particles impact said abrasive receiving and arresting means and are held thereon for subjection to a scrubbing action developed by the air moving therepast, said retained abrasive particles being removed, in substantial part, from said arresting means by impact of additional abrasive particles rebounding upwardly in said return chute, said baffle means and said magnetic particle receiving and arresting means cooperating with each other and with gravity to (a) change the direction of movement of abrasive particles from upward and laterally with respect with said surface to be cleaned, to downwardly in the general direction of said surface to be cleaned, and to (b) thoroughly air scrub abrasive particles to remove dust and debris therefrom, and to entrain such removed dust and debris from the air moving upwardly through said tortuous undulating path defined by said baffle means;

an abrasive conveyor disposed, in part, below said baffle means and said return chute for receiving gravitating abrasive and carrying said abrasive to a position above said storage hopper;

means for directing abrasive from said abrasive conveyor into said storage hopper by way, in part, of a gravitating curtain of abrasive which extends across the path of air discharged from said baffle means after flowing therethrough, whereby further removal of dust and debris from said abrasive is effected as air is moved from the baffle means to and through said gravitating curtain of abrasive; and passageway means for directing the flow of air between said baffle means and the point at which air is impinged upon abrasive in said gravitating curtain to effect said further removal of dust and debris from said abrasive.

* * * * *